United States Patent [19]

Sundman

[11] Patent Number: 4,558,477

[45] Date of Patent: Dec. 17, 1985

[54] PROCESS FOR WASHING FIBRE STOCK

[75] Inventor: Frey Sundman, Karhula, Finland

[73] Assignee: A. Ahlstrom Osakeyhtio, Noormarkku, Finland

[21] Appl. No.: 342,056

[22] Filed: Jan. 25, 1982

Related U.S. Application Data

[62] Division of Ser. No. 163,648, Jun. 27, 1980.

[30] Foreign Application Priority Data

Sep. 26, 1979 [GB] United Kingdom ..... 7933408

[51] Int. Cl.[4] ..... D21C 1/02

[52] U.S. Cl. ..... 8/156; 68/58; 68/158

[58] Field of Search ..... 8/156; 19/8; 68/58, 68/148, 152, 153, 158, 181 R, 184, 205 R, 207; 162/60

[56] References Cited

U.S. PATENT DOCUMENTS 1,899,106 2/1933 Richter et al. ..... 8/156

4,215,447 8/1980 Gartland ..... 162/60 X

*Primary Examiner*—Philip R. Coe

*Attorney, Agent, or Firm*—Bucknam and Archer

[57] ABSTRACT

A process for washing fibre stock. The fibre stock is described is passed along a passage 14 from a stock inlet 15 to a stock outlet 16. The passage is defined by a portion of the inner surface of a substantially horizontal cylindrical screen 4, preferably a wire gauze. Washing liquid such as water is introduced into the passage, preferably by means of apertures 9 in a longitudinally extending hollow member 8. Effluent liquid passes through the screen, for extraction e.g. through outlets 24 and 25.

To enable the washing of stock of high consistency e.g. up to 8%, while avoiding plugging of the screen 4, the arrangement is such that the stock only partially fills the cylindrical screen and is subjected to a tumbling action by the rotary movement of the cylindrical screen as the stock moves along the passage 14 to the stock outlet 16. The hollow member 8 is displaced downwardly from the axis of the cylindrical screen, so as to be positioned within the tumbling stock.

In an alternative arrangement, the screen is defined by an endless belt carried over a series of rollers and having a portion of upwardly concave cross-section.

9 Claims, 5 Drawing Figures

PROCESS FOR WASHING FIBRE STOCK

This is a division, of application Ser. No. 163,648, filed June 27, 1980.

This invention relates to a process and apparatus for washing fibre stock which is especially useful for the de-inking of paper.

The salvage and re-use of waste paper, in particular printed waste paper, is of considerable importance for both ecological and financial reasons. Thus salvage and re-use are of value in preserving natural resources and, if the operations are performed efficiently, can generate stock for use in paper manufacture less expensively than it can be obtained from natural sources.

A conventional de-inking process involves a number of steps. Thus, the waste may first be pulped with suitable chemicals in dilute aqueous solution, and extraneous material such as pieces of metal and plastics removed, to produce fibre stock. The stock is then cleaned, to produce what is commonly known as "grey stock". At this stage, ink particles will be in suspension. Finally, ink is removed from the stock by a washing or flotation method.

A conventional flotation technique involves the use of stock at consistencies no higher than 1%, although some systems may be capable of handling consistencies of up to 2%. This relatively low consistency requirement, coupled with the slow rate of ink removal by flotation, means that these techniques have several disadvantages.

In a conventional washing technique, the stock is diluted with e.g. clean water to a consistency of say 1%, and water containing suspended ink particles is then filtered off. However, as the stock thickens, and reaches for example a consistency of say 3–4%, it begins to exert a filtering action itself, retaining ink particles so that only clean water is drained off. This internal filtering reduces the efficiency of washing. Thus it proves necessary to re-dilute and re-drain the stock. Several repetitions of the washing technique are necessary before the stock attains the desired degree of brightness. The result is that large volumes of washing water are required, and that the capital expenditure on equipment for the several stages can be high.

A further problem arises in that fibres from the stock tend to block filter screeens and the like during the washing process, so that once again the efficiency is reduced and it may be necessary to clean the screens at frequent intervals. This problem will of course be more serious the higher the stock consistency.

U.S. Pat. No. 1,921,080 discloses apparatus for washing stock in which the stock is passed along a perforated cylinder by means of a screw conveyor, water being supplied through apertures in the conveyor shaft. This causes thorough agitation of the stock. Fibres and greasy printing ink will, however, collect in the perforations and means are specifically provided to clean the perforations. This involves the use of additional fluid. It is unlikely that this apparatus could efficiently wash stock of high consistency.

There would be advantages in a capability to wash stock effectively at high consistencies of say, between 2 and 8%. The volumes of washing water required would be reduced; chemicals could be used more effectively since they would not be diluted with unecessarily high volumes of water; and there would be reduced requirements for the thickening of de-inked stock before any subsequent stages, such as bleaching if necessary. On the other hand, the above mentioned problems of ink retention and filter screen blockage would be all the more serious.

It has been proposed in published U.K. Patent Application No. 2009274A to use a filter screen provided with a stirring member, wherein a relative rotary motion is effected between the filter screen and the stirring member, the arrangement being such that the fibres roll about in clusters.

Viewed from one aspect, the invention provides a process for washing fibre stock having a consistency in the range of 2 to 8%, wherein the stock is passed from an inlet end to an outlet end along a substantially horizontally disposed longitudinally extending filter screen portion curved so as to be upwardly concave in cross-section; washing liquid is introduced into the stock in the space defined by said screen portion at least in a region longitudinally remote from said inlet, by means of a longitudinally extending liquid supply member fixedly mounted so as to be downwardly radially displaced from the axis of curvature of said screen portion and immersed in said stock; and said screen portion is moved around said axis of curvature whereby the stock is subjected to a tumbling action as it passes along the screen portion.

The process is carried out in an apparatus for the liquid treatment of fibre stock, comprising a longitudinally extending filter screen, at least a portion of which is substantially horizontally disposed and is curved so as to be upwardly concave in cross-section, means for effecting movement of said screen portion around the axis of curvature thereof, means for supplying fibre stock to one end of said screen portion for passage therealong, means for removing fibre stock from the other end of said screen portion, and a longitudinally extending liquid supply member fixedly mounted so as to be downwardly radially displaced from said axis of curvature, said liquid supply member being provided with means for admitting treating liquid into the space defined by said screen portion, at least in a region longitudinally remote from said one end thereof.

The filter screen portion may for example be defined by a portion of the inner surface of a substantially horizontal rotating cylindrical screen. In use, washing liquid is introduced into the stock, effluent liquid passing through the cylindrical screen, and the stock partially filling the cylindrical screen, is subjected to the tumbling action by the frictional forces between the rotating cylindrical screen and the stock, and the gravity forces acting on the stock as it moves along the passage towards the stock outlet.

It has been found that by subjecting the stock to a tumbling action inside a rotating cylindrical screen, for example partially filled with stock, efficient removal of ink particles can be attained, whilst blocking of the filter screen to any substantial extent can be avoided. In a conventional process there will be a relatively even dispersion of fibres. It is then easy for these to settle on the filter screen, causing blockages; there may also be fibre loss through the screen. In accordance with the invention, although a solid web of stock will not build up to prevent flow through the passage, the fibres are not so dispersed that screen blockage and fibre loss will be substantial problems.

In published U.K. Patent Application No. 2 009 274A for example, it is necessary to use stirring members to effect movement of the stock in the screen. The washing liquid will be mixed with the stock due to the movement of the stock. In accordance with the present invention the movement of the stock can be brought about without any separate stirring members. The stock moves substantially in layers through which the washing liquid flows, thereby displacing liquid containing ink particles. The consumption of washing liquid is smaller and the power consumption lower. Plugging of the screen may be avoided and the apparatus can easily be put in operation after a stop.

In order to bring about the desired movement of the stock, the peripheral speed of the cylindircal screen should be in the range of about $0.5\sqrt{D}$ to $1.5\sqrt{D}$ m/s, and preferably about $1.0\sqrt{D}$ m/s, wherein D represents the diameter of the screen expressed in meters.

The cylindrical screen should be filled with stock to at least 10% of its volume, preferably to about 20 to 40%. A filling ratio of more than 60% should be avoided as this impairs the efficiency of the apparatus.

The washing liquid should preferably be introduced in or adjacent the centre of the tumbling stock, i.e. so that the stock is caused to revolve around the liquid supply member, by means of which the washing liquid is distributed.

In a preferred embodiment, the liquid supply member is provided with a plurality of apertures along its length and is disposed in the lower half of the cylindrical screen at a distance of 5 to 30% of the diameter of the screen to its inner surface. The shape of it should be such as to give a low resistance of flow.

The introduction of washing liquid at least in a region remote from the stock inlet may result in the clean liquid flowing in a generally countercurrent direction to the stock. Preferably, washing liquid is introduced along the length of the stock passage, so that stock therein is constantly contacted with e.g. wash water. This may reduce unevenness of stock consistency.

It may be desirable to set up a consistency gradient in the passage. Thus grey stock may be introduced at about 3 to 5% consistency, and cleaned stock removed at, say $5\frac{1}{2}$–$6\frac{1}{2}$ consistency. This could be achieved by extracting more effluent liquid than washing liquid is added.

According to a preferred embodiment of the invention, an effluent outlet is arranged so as to permit the withdrawl of effluent liquid from a location close to the stock inlet. The apparatus may then include recirculation means by which some of the effluent liquid may be withdrawn from a region extending from intermediate along the length of the passage and reintroduced to the passage as relatively clean liquid for washing stock, at a region between the region at which this recirculated liquid was withdrawn and the stock inlet. Conveniently effluent liquid for recirculation may be withdrawn from about half-way onwards along the passage. The concentration of suspended ink particles in the effluent liquid is very much greater in the region close to the stock inlet than in the region close to the stock outlet. Thus effluent liquid drained from half-way onwards along the passage is relatively clean any may be used in place of clean liquid for washing stock as it passes through the first half of the passage. An advantage of this arrangement is that it enables one to reduce by about one-half the quantity of washing liquid used in operation of the apparatus. The return of comparatively clean effluent liquid from a later section of the passage to an earlier section may be carried out in several stages if desired.

Instead of being in the form of a cylinder, the screen could be a continuous flexible belt-like member, suitably guided over rollers or the like to give a concave portion.

To achieve the desired advance movement of the stock from the stock inlet to the stock outlet, the screen can be slightly inclined or can be provided with helical ribs on its inner surface.

Two embodiments of the invention will now be described by way of example and with reference to the accompanying drawings in which.

Figure 1:
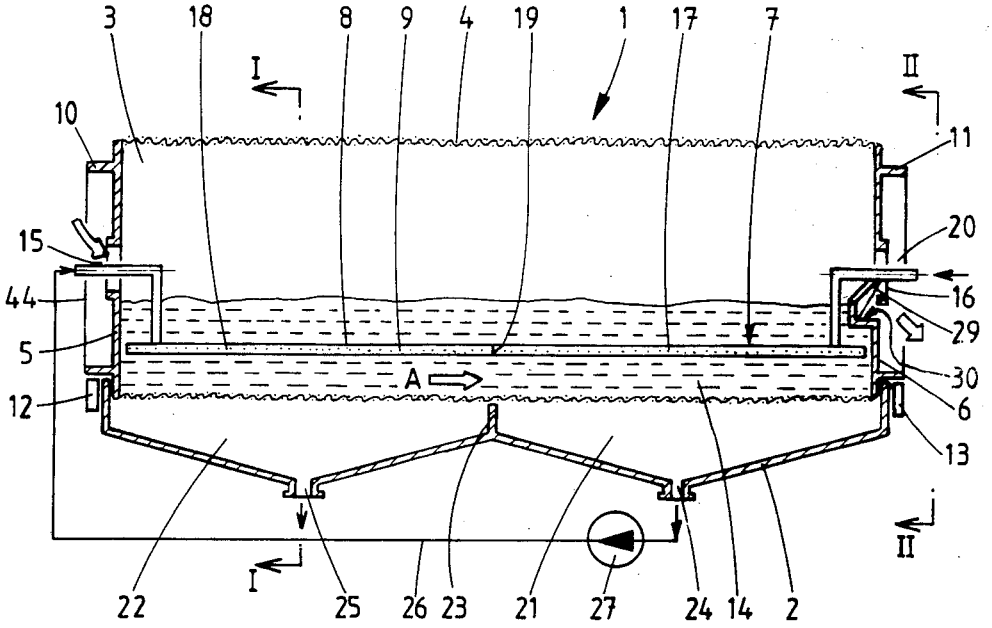
FIG. 1 is a diagrammatic vertical longitudinal section through apparatus in accordance with the invention.

Referring now to the drawings, the apparatus generally indicated 1 includes a vat 2 in which is disposed, for rotation about its generally horizontal axis, a cylindrical screen drum 3 comprising a cylindrical woven wire mesh 4 and end plates 5 and 6. The wire mesh is supported from the outside by a perforated structure or other suitable means (not shown). Within the screen drum 3 is disposed a means for introducing washing liquid generally indicated 7. The means 7 includes a flat hollow longitudinally extending member 8 provided with a number of apertures 9 along its length.

The member 8 is located beneath the axis of the screen, i.e. below its centre of curvature, and thus in the lower half of the cylindrical screen at a distance from the wire mesh. The shape of the member 8 is rounded to give a low resistance of flow. The end plates of the screen drum are provided with cylindrical flanges 10 and 11 by means of which the drum is supported on rollers 12 and 13. The drum is rotated by suitable drive means (not shown).

The cylindrical mesh 4 defines a passage 14 along which stock can be passed in the direction of arrow A from an inlet 15 at the end of the drum 3 to an outlet 16 at the other end of the drum. The axis of the screen drum is slightly inclined by e.g. about 1° to accomplish advance movement of the stock.

The hollow member 8 is divided into first and second sections 17 and 18 respectively by a partition 19. An inlet pipe 20 is provided for supplying fresh, clean water (or another suitable washing liquid), which is connected to the first section 17. From here the liquid is passed through apertures 9 into passage 14.

The vat is divided into first and second compartments 21 and 23 respectively by a partition 23. Each compartment of the vat has an outlet opening 24 and 25 respectively.

Effluent liquid can pass through the wire mesh 3 into the compartments 21 and 22 from whence it can be drawn off through outlet openings 24 and 25. The relatively clean effluent from compartment 21 is passed along a conduit 26 by means of a pump 27 and into a recirculated liquid inlet pipe 28. This pipe is connected to the second section 18. From here the recirculated liquid can pass through apertures 6 into passage 14.

The end plate 6 at the outlet end of the apparatus is provided with opening 28, helical blades 29, and cylindrically formed surfaces 30, which assist in extracting stock from the drum.

In use of the apparatus 1, clean water is supplied in a steady flow through inlet 20, and grey stock is supplied through inlet 15 so as to partially fill the screen drum 3, in this embodiment to a level below the axis of the drum when not rotating.

The screen drum is continuously rotated at a relatively slow rate. The grey stock which enters through inlet 15 is of relatively high consistency i.e. between 2 and 8%. As the stock advances in the drum, it is continuously brought into contact with washing water. This water takes up ink particles as a suspension, and passes through the mesh 4 for removal as effluent through outlet 25 at the lower end of the apparatus. The effluent in compartment 21 at the outlet end of the apparatus is relatively clean, and is thus recirculated by means of pump 27, for use in washing grey stock at the inlet end of the apparatus. As the grey stock advances up the apparatus, the stock becomes progressively cleaner. The cleaned stock is discharged at the outlet end of the apparatus through outlet 16, this being assisted by the action of the helical blades 29.

A steady state will be reached with grey stock and clean water being continuously fed to the system, and cleaned stock and effluent water being continuously removed. The pump 27 will also function continuously.

Figure 2:
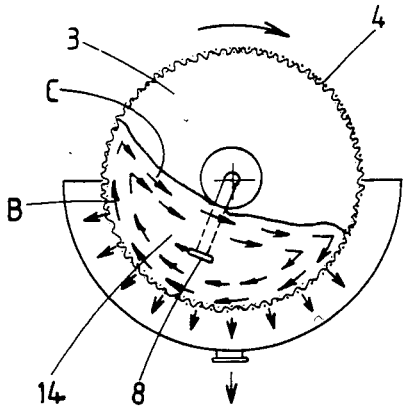
FIG. 2 is a sectional view taken on the line I—I of FIG. 1.
Figure 3:
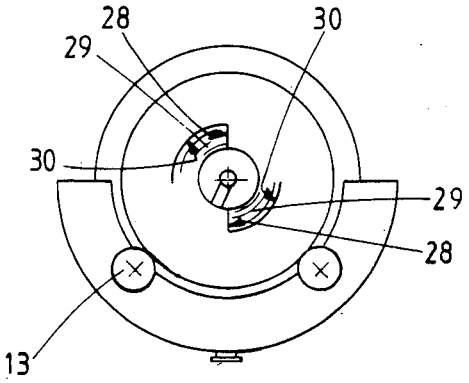
FIG. 3 is an elevational view taken on the line II—II of FIG. 1.

As the drum rotates the fibres in the stock near the inside of wire mesh 3 will move, due to the frictional forces between the wire mesh and the stock, in the direction of arrow B in FIG. 2. The stock will follow the movement of the wire mesh until the gravitional forces will cause it to flow away from the wire mesh in the direction of arrow C. The stock tumbles without being mixed in the drum around the hollow member 8 through which washing liquid is introduced in the stock. Liquid containing ink particles is displaced outwardly to and through the wire mesh.

In this manner, effective ink removal is achieved, whilst blocking of the mesh 3, is avoided. The apparatus is thus capable of continuously de-inking grey stock.

According to the quality of stock required, the various parameters such as flow rates, drum speed and so forth, may be varied. In general, the brighter the stock required, the longer will be the residence time in the apparatus. Suitable flow meters or the like could be used to monitor operation of the apparatus.

It has been found that apparatus in accordance with the above embodiment may readily be operated at 2 tonnes or more of fibre per square meter of mesh per day. Thus a 5 square meter mesh will provide adequate supplies without the apparatus being undesirably large.

Figure 4:
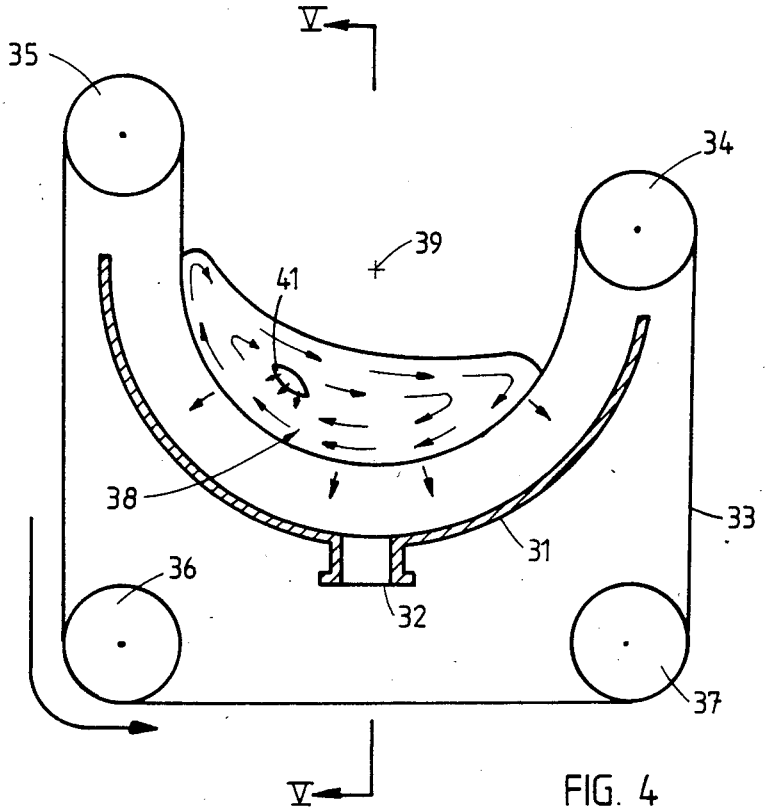
FIG. 4 is a transverse section through a second embodiment of apparatus in accordance with the invention.
Figure 5:
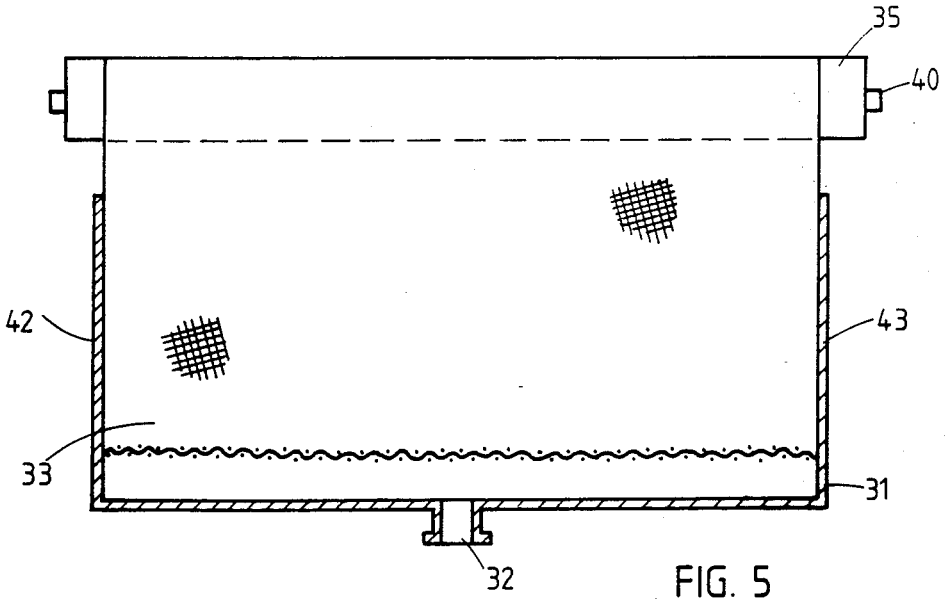
FIG. 5 is a vertical longitudinal section on the line V—V of FIG. 4.

Referring now to the embodiment of FIGS. 4 and 5, the apparatus includes a vat 31 if semi-circular cross section, provided with an effluent outlet 32. A continuous filter belt 33 of wire mesh is guided over rollers 34, 35, 36 and 37. Between rollers 34 and 35, the belt is unsupported and forms an upwardly concave filter screen portion 38 of substantially semi-circular cross section having an axis of curvature 39. The screen is driven around the axis 39 by the rollers—for example roller 35 being driven by a shaft 40. As the screen is driven, stock filling the lower part of the curved section below axis 39 tumbles as in the previous embodiment. Within the tumbling stock is a liquid supply member 41 similar to that 8 of the previous embodiment. The ends of the screen portion 38 are sealed against end plates 42 and 43 of the vat, by means of flanges (not shown). In other respects the operation of the apparatus is similar to that of the previous embodiment.

Although the apparatus has been described primarily in terms of de-inking, it should be understood that it is not limited to this particular application. It can be used for other washing purposes and can also be used in connection with chemical treatment of fibre stock.

I claim:

1. A process for washing fibre stock having a consistency in the range of 2 to 8%, wherein the stock is passed from an inlet end to an outlet end along a substantially horizontally disposed longitudinally extending filter screen portion curved so as to be upwardly concave in cross-section; washing liquid is introduced into the stock in the space defined by said screen portion at least in a region longitudinally remote from said inlet by means of a longitudinally extending liquid supply member fixedly mounted so as to be downwardly radially displaced from the axis of curvature of said screen portion and immersed in said stock, and said screen portion is moved around said axis of curvature whereby the stock is subjected to a tumbling action as it passes along the screen portion and the cylindrical screen is filled with stock to up to 60% of its volume.

2. A process as claimed in claim 1, wherein the filter screen portion is defined by a hollow cylindrical screen.

3. A process as claimed in claim 2, wherein the cylindrical screen is filled with stock to at least 10% of its volume.

4. A process as claimed claim 2, wherein the cylindrical screen is filled with stock to about 20 to 40% of its volume.

5. A process as claimed in claim 2, wherein the peripheral speed of the cylindrical screen is in the range of $0.5\sqrt{D}$ to $1.5\sqrt{D}$ m/s, wherein D represents the diameter of the screen expressed in meters.

6. A process as claimed in claim 1, wherein the washing liquid is introduced into the stock at a plurality of points along the length of the screen portion.

7. A process as claimed in claim 1, wherein the washing liquid is introduced in or adjacent the longitudinal centre line of the tumbling stock.

8. A process according to claim 1 wherein said liquid supply member is divided into a first and a second portion by a partition and admits the washing liquid, said washing liquid being introduced into said first portion of said liquid supply member in or adjacent the center of the tumbling, then into said screen, said washing liquid flowing generally countercurrently to the direction of travel of said fiber stock.

9. The process according to claim 8 wherein said washing liquid, is removed as effluent liquid and is withdrawn at a location close to said outlet end of the stock and is recirculated into the second portion of said liquid supply member to a location close to the inlet end of the stock.

* * * * *